United States Patent [19]

Coffee et al.

[11] Patent Number: 4,634,057

[45] Date of Patent: Jan. 6, 1987

[54] PUMPS AND PUMP COMPONENTS

[75] Inventors: Ronald A. Coffee, Haslemere; Timothy J. Noakes, Midhurst; Robert A. Anstey, Walton-on-Thames, all of England

[73] Assignee: Imperial Chemical Industries PLC, London, England

[21] Appl. No.: 771,167

[22] Filed: Sep. 3, 1985

Related U.S. Application Data

[63] Continuation of Ser. No. 515,267, Jul. 19, 1983, abandoned.

[30] Foreign Application Priority Data

Aug. 25, 1982 [GB] United Kingdom ..... 8224408

[51] Int. Cl.[4] ..... B05B 5/02

[52] U.S. Cl. ..... 239/690; 239/302; 315/111.81; 417/48

[58] Field of Search ..... 239/3, 302, 332, 690, 239/691; 315/111.81; 313/231.01, 231.31, 231.41; 417/48

[56] References Cited

U.S. PATENT DOCUMENTS

| | | | |
|---|---|---|---|
| 3,267,859 | 8/1966 | Jutila | 417/48 |
| 3,398,685 | 8/1968 | Stuetzer | 417/48 |
| 3,581,997 | 6/1971 | Stevenson | 239/332 |
| 4,328,940 | 5/1982 | Malcolm | 239/691 |
| 4,358,059 | 11/1982 | Coffee | 239/691 |

FOREIGN PATENT DOCUMENTS

| | | |
|---|---|---|
| 1142241 | 2/1969 | United Kingdom . |
| 1237939 | 7/1971 | United Kingdom . |
| 1301304 | 12/1972 | United Kingdom . |
| 1571201 | 7/1980 | United Kingdom . |
| 1584640 | 2/1981 | United Kingdom . |

OTHER PUBLICATIONS

Stuetzer, Otmar M.; "Ion Drag Pressure Generation"; *Journal of Applied Physics*, vol. 30, No. 7, Jul. 1959, pp. 984–994.

*Primary Examiner*—Jeffrey V. Nase
*Assistant Examiner*—Michael J. Forman
*Attorney, Agent, or Firm*—Cushman, Darby & Cushman

[57] ABSTRACT

An electrostatic pump or pumping liquids having a resistivity in the range of $10^{10}$ to $10^{7}$ ohm cm has a pump housing. The pump housing includes a passageway through which the liquid is pumped, and a single injection electrode disposed upstream of the passageway. The electrode has a sharp electrically-conducting tip. A constriction in the region of the tip is shaped to conform to the surface configuration of the tip so that the liquid flows pass the tip in a laminar nonturbulent fashion through an orifice of reduced cross-section. The constriction is so dimensioned as to provide a high resistance path. A chamber is disposed downstream of the constriction and is of larger cross-section than the constriction. A discharged electrode is disposed in the chamber and is separated from the injection electrode by the chamber and the constriction. The injection and discharge electrodes are coupled to a high voltage generator to maintain an electric potential between the electrodes on the order of kilovolts.

21 Claims, 15 Drawing Figures

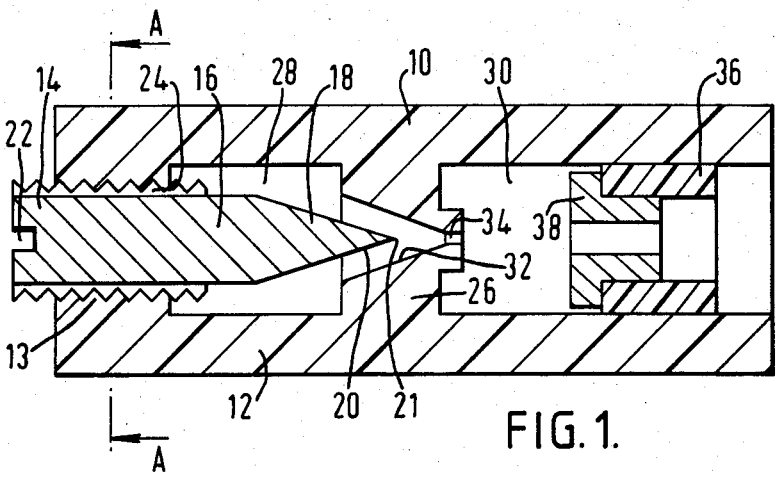
FIG. 1.
FIG. 2.
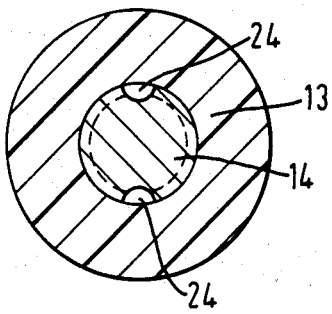
FIG. 3.
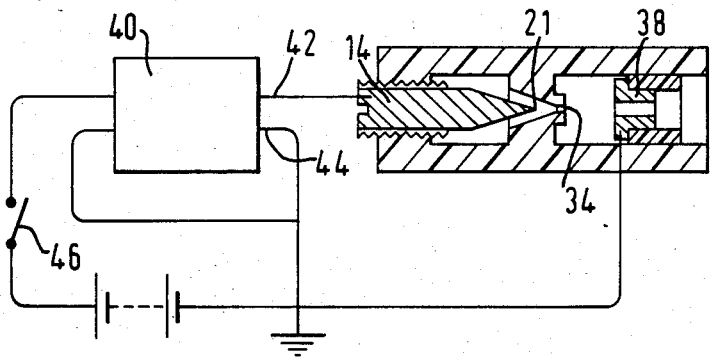

PUMPS AND PUMP COMPONENTS

This is a continuation of application Ser. No. 515,267, filed July 19, 1983, which was abandoned upon the filing hereof.

This invention relates to electrostatic pumps suitable for pumping relatively non-conducting liquids.

In our published European Patent Application No. 80303705 we describe an electrostatic liquid spraying system using an electrostatic pump. The pump comprises an injection electrode with a sharp point or edge for injecting charge carriers into the liquid and downstream thereof a collector electrode of opposite polarity for taking up said injected charge carriers. Electrostatic forces acting on the injected charge carriers set up pressure which transports the liquid from the first to the second electrode without any moving mechanical parts. The charge carriers are probably ions of some kind; for convenience, they are hereinafter referred to as 'ions' but this is not to be understood as any restriction on the physical nature of the charge carriers.

The system described, though very elegant in principle, is found to have certain defects in practice. Over extended periods of use, the pump pressure is generally found to vary, typically decreasing, in a not fully predictable way. The electric current used by the pump depends on the resistivity of the liquid being pumped; at resistivities of the order of $10^{10}$ ohm centimeters it is acceptable, but increases rapidly as resistivity drops to $10^{8}$ ohm centimeters, wasting energy and producing unwanted heat. Also, the pump is found to be prone to electrical breakdown by the establishment of an ionised charge pathway between the two electrodes. Such a pathway, once established, is not easy to remove, and it may produce gas bubbles which block the pump mechanically.

We have now devised an improved form of the pump disclosed in EPO published Patent Application No. 80303705 which is able to overcome a number of the difficulties outlined above.

According to the present invention we provide an electrostatic pump comprising:

- an injection electrode assembly having a sharp electrically conductive tip;
- a region downstream of the electrode;
- electrical connections for maintaining a potential difference of the order of kilovolts between the downstream region and the electrode;
- and a channel communicating between the electrode and the downstream region;
- the channel being shaped to conform at least partially to the shape of the electrode assembly and to promote laminar, non-turbulant liquid flow past the tip in use.

The electrode tip may be in the form of a point or an edge or any other shape which is efficient for the generation of charge carriers.

The expression "of the order of kilovolts" is not intended to be narrowly interpreted and it is difficult to set precise limits because these will vary with other operating parameters. In practice it has been found under the conditions so far explored that most useful results are obtained within the range from about 3 kv to about 100 kv. Below the range pumping action begins to fall of whilst above the range although pumping action is theoretically possible problems of dielective breakdown begin to occur.

The expression "downstream" is with reference to the intended direction of flow through the pump in use.

Specific embodiments of the invention will now be described with reference to the drawings, in which:

FIG. 1 is an axial section through a pump according to the invention;

FIG. 2 is a radial section along the line A—A of FIG. 1;

FIG. 3 is a circuit diagram for the pump of FIGS. 1 and 2;

Figure 4:
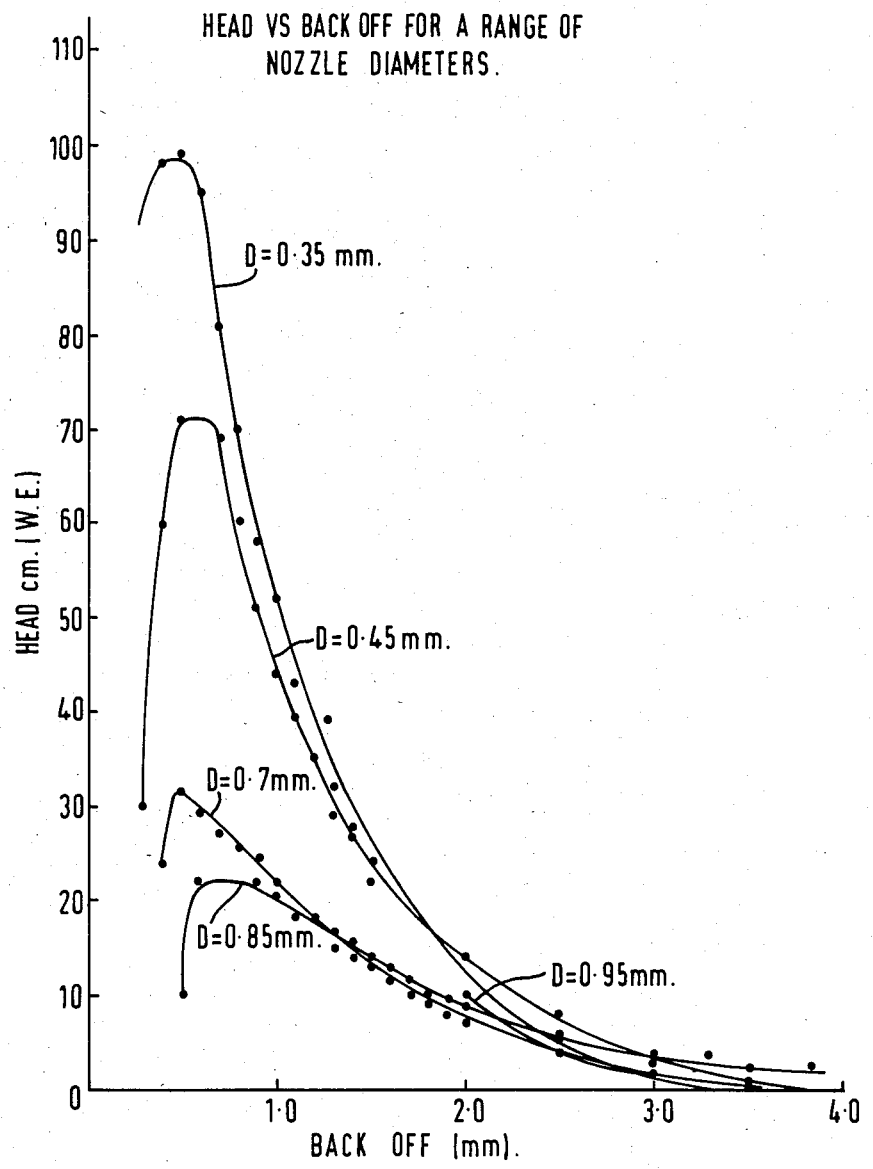
FIG. 4 is a graph of "back-off" distance against pumping pressure for various pumps according to the invention.

The pump shown in FIGS. 1 and 2 comprises a tubular body 10 of rigid insulating plastics material (e.g. nylon or polyacetal) and having an internal diameter of about 2 mm. The upstream end 12 of the body 10 is formed with an internally threaded collar 13 to receive an injection electrode assembly 14. The electrode is of mild steel, in the form of an externally threaded cylinder 16 terminating at the downstream end in a right cone 18 (apex angle 36°), the tip 20 of which is ground to a sharp point 21. The upstream end of electrode assembly 14 has a slot 22 which may be used to screw the electrode into the collar 13 to varying distances. Two diametrically opposed grooves 24 are formed in the threaded surface of cylinder 16, to act as conduits to deliver liquid to the interior of body 10. Body 10 is formed with an internal bush 26 dividing body 10 into an upstream chamber 28 and a downstream region including chamber 30. Bush 26 is integral with body 10, and is formed with a central conical recess 32 which receives cone 18 of the electrode assembly 14. The shape and size of conical recess 32 corresponds closely to that of cone 18, except that the cone apex angle of recess 32 is slightly greater (40°). At the centre of bush 26 is a cylindrical channel orifice 34, 0.2 mm in diameter and 0.2 mm in length, which allows liquid to pass from upstream chamber 28 to downstream chamber 30. The bush 26 comprises means defining the orifice 34. In downstream chamber 30, a bush 36 of insulating plastics material forms a housing for a smooth metal bush 38 which is spaced away from the exit of channel 34 and which acts as a discharge (collector) electrode. The system is provided with a battery-powered variable high voltage generator 40, capable of producing up to 40 KV at 50 microamps.

The circuit is illustrated in FIG. 3; one terminal 42 of generator 40 is connected to injection electrode assembly 14, the other terminal 44, to discharge (collector) electrode 38 and to earth. A switch 46 controls the supply of power from the batteries 48 to generator 40.

In operation, liquid (eg, a solution of an insecticide in an organic solvent, having a viscosity of 8 centistokes and a resistivity of $1\times10^8$ ohm centimeters—both measured at 25° C.) is introduced into chambers 28 and 30 through grooves 24. Switch 46 is turned on, to activate the generator 40 at a voltage of, say, 20 KV. This sets up a powerful voltage gradient between point 21 of electrode assembly 14 and liquid in chamber 30. Ions are injected from point 21 and attracted through channel 34 to liquid in chamber 30, being ultimately discharged at electrode 38. This produces a steady pumping action. Liquid in channel 34 functions as a high resistance, limiting electric current flow.

Provided that a high potential difference is maintained between electrode assembly 14 and discharge electrode 38 it has been found that it does not matter which is at high potential and which is earthed. In some arrangements eg. those in which the discharge electrode is adjacent to an electrostatic sprayhead it may be found convenient for both electrode and sprayhead to be maintained at similar high potentials.

Figure 5:
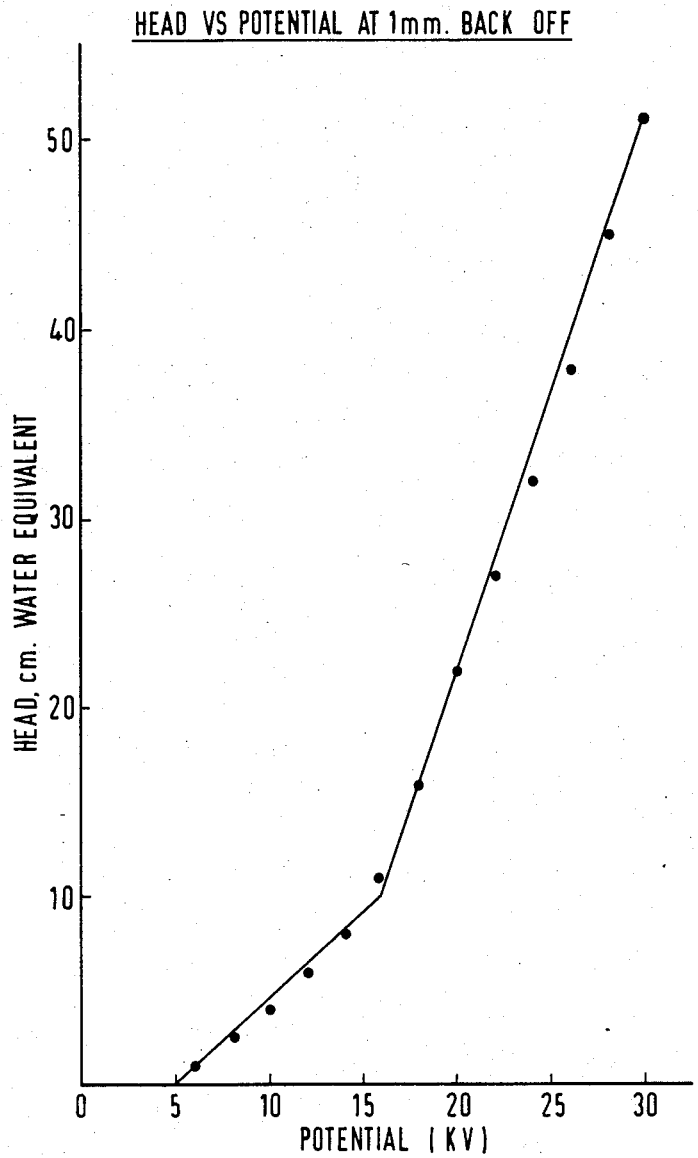
FIG. 5 is a graph of pumping pressure against voltage for a further pump according to the invention.

Pressure obtainable by pumps of the type described above can be up to 1 atmosphere, though this depends on the pump dimensions, the voltage applied and liquid being pumped (de-gassed liquid works best), and also, most importantly, on the positioning of the point 21 of the injection electrode assembly 14. FIG. 4 is a graph of "back-off distance" (axial displacement of the tip of the electrode back from the narrowest downstream portion of the channel) against pumping pressure for pumps of the type illustrated. Using a liquid of resistivity $4.4\times10^8$ ohm cm at 25° C., an applied voltage of 17 KV and constriction diameters (channel 34) of 0.35 to 0.895 mm, static pumping pressures of up to nearly 1 meter (equivalent water head) were obtained, with the maximum head being obtained at back-off distances of between about 0.1 and 1.0 mm. FIG. 5 shows a graph of potential in kilovolts against static head obtained, over a range of from 0–50 KV, using the same liquid as in FIG. 4 with a constriction 0.3 mm long, 0.6 mm diameter and a back-off distance of 1.0 mm. Greater back-off distances, eg, up to 10 mm or more, may be found useful in certain circumstances.

It will be seen from the foregoing that the dimensions of the channel 34 and the back-off distance are significant parameters of our device. In the light of the information given, suitable dimensions for any desired application may readily be determined by simple experiment, but for the applications we have tried so far we find in general that suitable dimensions for the channel 34 are in the range of about 0.1 to 1 (particularly around 0.2) mm diameter and 0.1 to 5 (particularly around 0.2 to 0.3) mm length; and a back-off distance in the range of about 0.25 to 3 (particularly about 0.4 to 1.0 mm). These ranges are not necessarily limiting. Liquids of lower resistivity may require relatively longer or narrower constricting passages, or both, while a greater back-off distance may be found to work better with a shorter or wider constriction.

Figure 6:
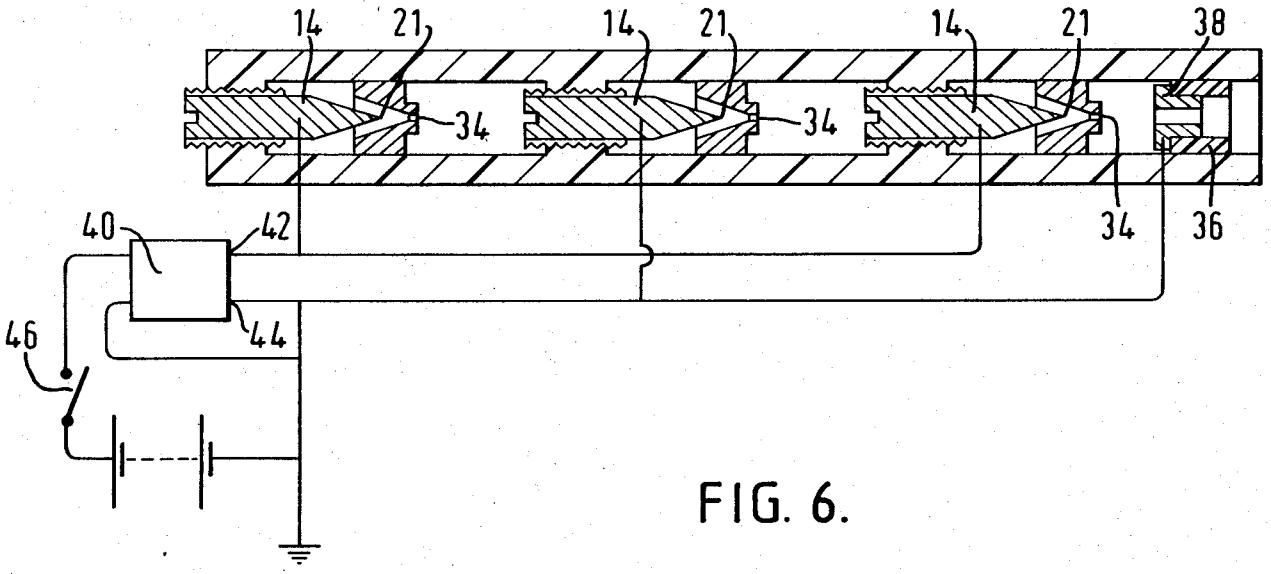
FIG. 6 is a schematic diagram of three pumps of the type shown in FIGS. 1–3 arranged to operate in series.
Figure 7:
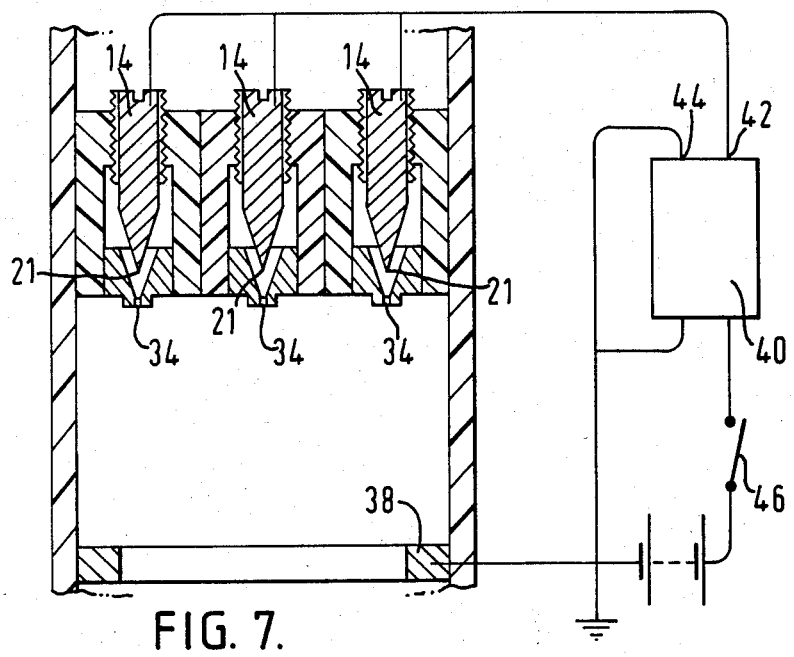
FIG. 7 is a schematic diagram of three pumps of the type shown in FIGS. 1–3 arranged to operate in parallel.
Figure 8:
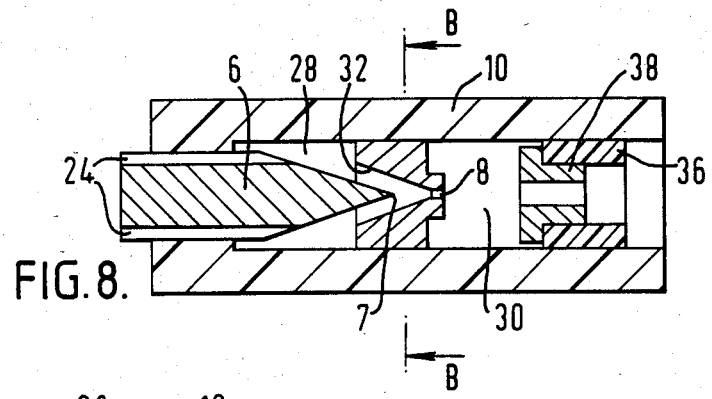
FIG. 8 is a longitudinal section through a pump according to the invention having a blade electrode.
Figure 9:
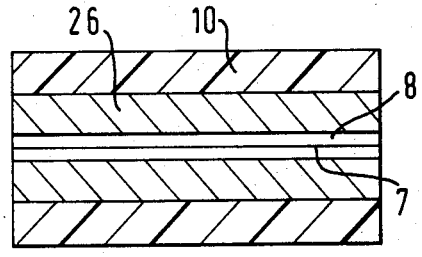
FIG. 9 is a section along the line B—B of FIG. 8.

In general, the pump is most suitable for pumping liquids with resistivities in the range from about $10^{10}$ to $10^7$ ohm cm, and it may not be found to work well, or even at all, with some liquids outside these resistivity ranges. The pump is particularly suited for use in electrostatic sprayers, but may also find other uses. Multistage pumps may be contructed, to run in series (as in FIG. 6 where the injection electrodes of the second and third stages of the pump serve as discharge electrodes for the preceding stage) or in parallel (as in FIG. 7), or in combinations of the two. Instead of an electrode with a sharp point opposite a cylindrical passage, there may be provided an electrode with a conductive edge, a blade 6 having a sharpened edge 7 placed opposite a slit 8, as shown in FIGS. 8 and 9.

Figure 10:
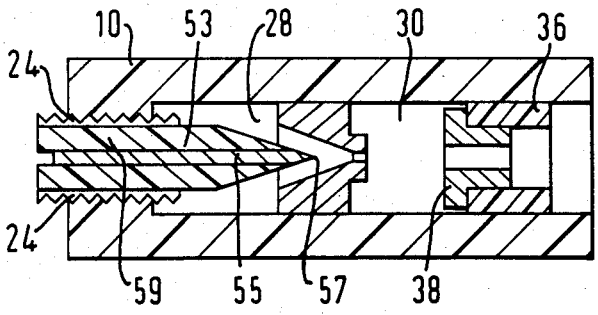
FIG. 10 is a longitudinal section through a further pump according to the invention.

It is not necessary that the injection electrode assembly be constructed completely of conductive material, and indeed for certain purposes it is advantageous that it should not be. When spraying dispersions (eg of finely-divided insoluble pesticides) it is found that interactions may occur between the charged surface of the injection electrode and the particles of the disperse phase, which can diminish the pumping effect and make it unreliable. Such effects are lessened by making only the tip of the injection electrode assembly conductive. FIG. 10 shows a section through a pump having an electrode assembly 53 of pencil-like construction, with a central conductive core 55 of graphite sharpened to a point 57, embedded axially in a cylinder 59 of non-conductive plastics material. The shape of electrode assembly 53 and of other parts of the pump, and the electrical circuit, are otherwise the same as in FIGS. 1–3. It is found that this arrangement pumps dispersions more reliably than the pump shown in FIGS. 1–3.

A wide range of conducting materials may be used for the conducting parts of the electrode assembly with acceptable performance. It is preferred to use materials which are resistant to corrosive-type attack under conditions of storage and use for example stainless steels.

Wherever possible, the body of the pumps of our invention should be of integral construction. Otherwise charge may leak through cracks from one chamber to the other. Thus the construction shown in FIGS. 1 and 11 is to be preferred to that shown in FIGS. 7–10.

Figure 12:
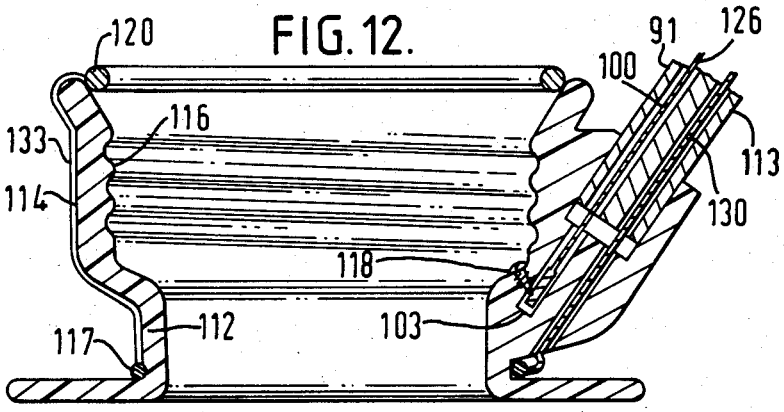
FIG. 12 is an axial section through part of a holder for the container of FIG. 11.
Figure 11:
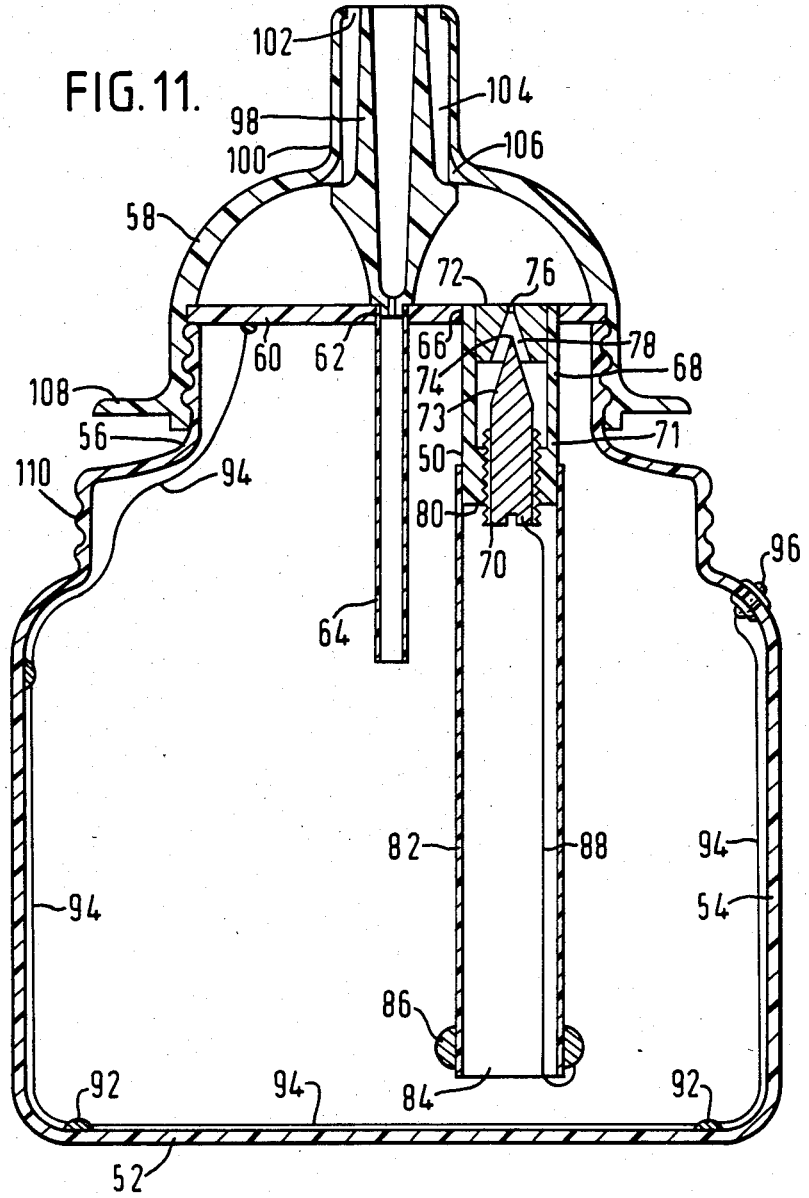
FIG. 11 is an axial section through a spraying container encorporating a pump according to the invention.

One useful application for the pump according to the invention is illustrated in FIGS. 11 and 12. These show a pump 50 according to the invention mounted in a container 52 for electrostatic spraying of pesticides. The container comprises an insulating polyethylene terephthalate body 54, formed by blow-moulding, the neck 56 of which is fitted by means of screw threads with a nozzle 58 of conducting plastics (nylon filled with carbon black). Within nozzle 58, the base of neck 56 is closed by a disc 60 of insulating polyacetal. In the centre of disc 60 an aperture 62 carries a long thin but rigid PTFE plastics pipe 64 serving as an air inlet. In one side of disc 60 a second larger aperture 66 houses a pumping element 68 according to the invention. This comprises a metal electrode assembly 70 supported in an insulating (PTFE) plastics tubular housing 71 having its downstream end 72 flush with the outer surface of disc 60. The electrode assembly 70 terminates in a cone 73 having a sharp point 74 opposite a narrow passage 76 (length 0.2 mm, diameter 0.2 mm). The housing 71 forms a conical recess 78 of angle 40° around the cone 73 of angle 36°, thereby providing a smoothly tapered liquid channel for leading liquid into passage 76. On the upstream end 80 of housing 71 is secured a readily flexible plastics tube 82 of length slightly less than the depth of container 52. Around the inlet end 84 of tube 82 is secured a thick metal bush 86 serving as a sinking weight. A thin metal wire 88 running along the inside of tube 82 maintains electrical contact between electrode assembly 70 and bush 86. Metal studs 92 spaced apart in body 54 are electrically connected to each other by wires 94 and also to an external electrical contact 96 (the same function could be performed by a metallic strip down one side of body 54).

Nozzle 58 consists of inner and outer tubes 98 and 100 respectively, which between them form an annular channel 102 for receiving liquid from pump 68. Over part of its length channel 102 is divided into longitudinal grooves 104 by ribs 106 formed on the outer surface of tube 100. The construction of this part of the nozzle is shown in more detail in published European Application No. EP-51928, the disclosure of which is incorporated herein by reference. The interior of the inner tube 98 forms a liquid-tight seal with the base of disc 60, providing a pathway for air through tube 98 into pipe 64. A resilient circumferential radial flange 108 is provided on outer tube 100 to act as an electrical contact.

Figure 13:
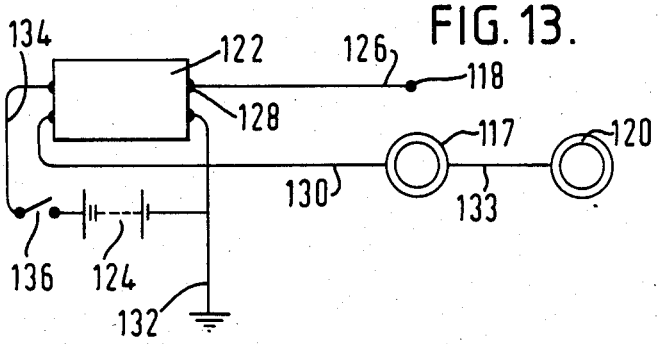
FIG. 13 is a circuit diagram for the holder of FIG. 12.

Adjacent flange 108, body 54 carries a screw-thread 110 which serves to mount container 52 in a spraying holder 112 shown in more detail in FIGS. 12 and 13. Holder 112 is provided with an elongated body 113 (only partly shown in FIG. 12) serving as a handle, and with an annular neck 114 carrying an internal screw-thread 116 for mating with thread 110 and an annular metal field-intensifying electrode 117. On neck 114 are provided two electrical contacts 118 and 120 (the latter in the form of a metal annulus) which serve to contact flange 108 and contact 96 respectively. A high voltage generator 122 powered by dry cells 124 and capable of providing a voltage of 25 KV at a current of 20 microamps is mounted in body 113. A conductor 126 provides an electrical connection from contact 118 to one terminal 128 of generator 122; conductor 130 connects electrode 117 to earth via a trailing earth lead 132. Conductor 133 connects electrode 117 to annular contact 120. Conductor 134 connects cells 124 with generator 122 via a push-button switch 136.

In operation, body 54 is filled with a liquid to be sprayed (for example, a 3% solution of the insecticide cypermethrin in a hydrocarbon diluent, the solution having a resistivity of $1.2\times10^8$ ohm cm and a viscosity of 14 centistokes, both at 25° C.) and the nozzle 58 is then mounted securely on it. These are generally manufacturing operations. Prior to use, the container 52 is firmly screwed into the neck 114 of holder 112, so that flange 108 touches contact 118 and contact 96 touches contact 120. The pump 68 is then primed by pointing the nozzle 58 downwards, when hydrostatic pressure sucks air in through pipe 64 while liquid drips slowly from the end of the nozzle 58. Nozzle 58 is now pointed at the target (eg, plants) which it is desired to spray, and the switch 136 is closed. This activates generator 122 and charges nozzle 58, via conductor 126 and contact 118 to a potential of 25 KV. The potential difference thereby set up between charged liquid in nozzle 58 and earthed pump electrode assembly 70 causes pumping of liquid from body 54 into nozzle 58. Liquid at the tip of nozzle 58 is drawn out by the electrostatic field into thin threads or ligaments which break up into charged droplets of very uniform size and propelled by the field towards and onto the target.

Unlike a container having a gravity feed, this device will spray in all directions. When the container 52 is inverted, so that nozzle 58 points upwards, the weighted bush 86 falls to the bottom of the container 52, so that the mouth 84 of flexible tube 82 remains beneath the surface of the liquid, and pump 50 remains primed. Whatever the orientation of container 52, mouth 84 is kept below the surface of the liquid until container 52 is nearly empty. The ability to spray in all directions is a substantial advantage over known containers of this type. However, a variant of the container shown, in which tube 82 and bush 86 are removed, is also useful. Though it can only spray with the nozzle 58 pointing downwards, it can have a steadier spray delivery rate than known devices relying on gravity feed. A steady spray rate is often important in agricultural applications. In another variant of container 52, pump 50 replaces bush 86 at the end of tube 82. This device primes much more easily; however a conductor wire is needed to bring high voltage along tube 82 to within a reasonable distance of the pump 50, and it is necessary to make tube 82 of highly insulating material (eg, PTFE) or charge will leak through the tube walls.

Figure 14:
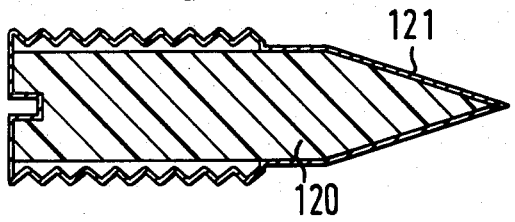
FIG. 14 is a longitudinal section through an alternative electrode assembly for use in the pump of FIG. 10.

FIG. 14 shows an alternative electrode assembly for use in the pumps of FIG. 1 or 10. It comprises a rigid plastics (eg, polyacetal) body 120 having the same shape as electrode assembly 14 of FIG. 1, metallised all over with a thin layer 121 (less than 1 micron thick) of aluminium or copper. Such electrode assemblies do not require to be fabricated by metal grinding techniques, but can be made in large numbers by plastics injection moulding, followed, eg, by vacuum metallising. They do not have as long a life as metal electrodes, but are satisfactory in devices intended for only limited use.

Figure 15:
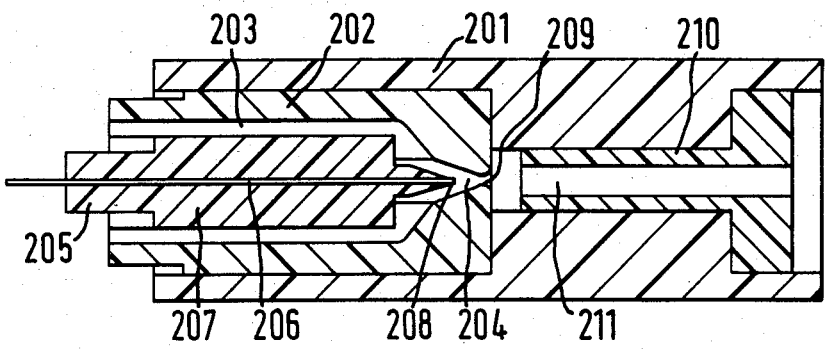
FIG. 15 is a longitudinal section through a modified pump according to the invention.

FIG. 15 shows a modified pump design having an outer casing 201 of electrically insulating polyacetal of generally cylindrical shape. An inner casing 202 of the same material is mounted within the outer casing and defines a passageway 203 for liquid to be pumped leading to a channel 204 of reduced cross-section at its downstream end.

An electrode assembly 205 of circular cross-section comprises a stainless steel (British standard EN56, a ferromagnetic alloy composition) wire 206 of diameter 0.125 mm encased in polyacetal 207 except for its downstream tip 208.

The channel 204 is shaped to conform with the conical downstream end of the electrode assembly and the downstream edges 209 of the channel are rounded off. It has been found in practice that this improves the laminar flow of liquid through the channel.

The pump casing also holds a discharge electrode 210 of carbon-loaded nylon forming part of a downstream region 211, and the pump in general functions in the same way as those described previously.

Variations in performance can be obtained by varying the dimensions and other operating parameters.

For example the following figures were obtained using a cyclohexanone/white oil formulation.

Flow rate (at zero back pressure)—12 cc/min,
Pressure (at zero flow rate)—5 psi,
Current ($1\times10^8$ ohm cm)—4 ua,
Acceptable resistivity range of formulations—$5\times10^7$ to $5\times10^9$ ohm cm,
Applied voltage—up to 40 kv.

In the above Example the narrowest part of the channel had a diameter of 0.35 mm and a length of 0.3 mm with an electrode "back-off" of 0.8 mm.

Further tuning of the pump can result in the further optimisation of one performance characteristic at the expense of others.

Hence a pump with a $0.175\times0.175$ (mm) hole only delivers about 4.5 cc/min at 25 kV, but is capable (with degassed formulation) of developing pressures up to 15 psi. Conversely, a pump with a larger flared hole (say, with a maximum hole diameter of 0.5 mm) is capable of producing flowrates up to 25 cc/m, but is only capable of developing pressures up to 1–2 psi.

We claim:

1. Apparatus for spraying liquids having a resistivity in the range $10^{10}$ to $10^7$ ohm cm, comprising in combination a spray head;

means for delivering liquid to said spray head under pressure, to be sprayed by said spray head, said delivery means comprising:

an electrostatic pump including a housing, the housing containing:

a passageway for liquid to be pumped through said housing;

a single injection electrode disposed in an upstream position of said passageway, said electrode having a sharp electrically-conducting tip;

a constriction in the region of the tip of said injection electrode, so shaped as to conform to the surface configuration of said tip so that liquid being pumped flows past the said tip in laminar nonturbulent flow through an orifice of reduced cross-section, and so dimensioned as to provide a high resistance path in said liquid; and a chamber disposed downstream of said constriction and of larger cross-section than said constriction; a discharge electrode disposed in said chamber and separated by said chamber and said constriction from the injection electrode; electrical connections to provide an electrical connection from a high voltage generator to said injection and discharge electrodes to maintain an electric potential of the order of kilovolts therebetween.

2. Apparatus as recited in claim 1 wherein said spray head is an electrostatic spray head.

3. Apparatus as recited in claim 2 further comprising a container which contains liquid to be pumped by said electrostatic pump to said spray head, said container operatively connected to said passageway inlet.

4. Apparatus as recited in claim 3 wherein said container comprises means for mounting said electrostatic pump therein with said passageway inlet in operative communication with liquid in the interior of said container.

5. An electrostatic pump according to claim 4 wherein said injection electrode is screw-threaded into engagement with said housing so that the position of said tip with respect to said orifice may be adjusted.

6. An electrostatic pump according to claim 5 wherein said injection electrode includes a screw-threaded external surface, and further comprising means defining a pair of grooves in said threaded surface of said injection electrode to provide said inlet to said passageway.

7. An electrostatic pump for pumping liquids having a resistivity in the range of $10^{10}$ to $10^7$ ohm cm, comprising a housing; said housing containing;

a passageway for liquid to be pumped through said housing;

a single injection electrode disposed in an upstream position of said passageway, said electrode having a sharp electrically-conducting tip;

a constriction in the region of the tip of said injection electrode, so shaped as to conform to the surface configuration of said tip so that liquid being pumped flows past the said tip in laminar nonturbulent flow through an orifice of reduced cross-section, and so dimensioned as to provide a high resistance path in said liquid; and a chamber disposed downstream of said constriction and of larger cross-section than said constriction; a discharge electrode disposed in said chamber and separated by said chamber and said constriction from the injection electrode; electrical connections to provide an electrical connection from a high voltage generator to said injection and discharge electrodes to maintain an electric potential of the order of kilovolts therebetween.

8. An electrostatic pump according to claim 7, wherein said orifice is circular in cross-section, having a diameter between 0.1–1 mm, and having a length between 0.1–5 mm.

9. An electrostatic pump according to claim 8 wherein the tip of said injection orifice is displaced from said orifice a distance of between 0.025–0.3 mm.

10. An electrostatic pump according to claim 7 wherein the tip of said injection electrode is of conical configuration.

11. An electrostatic pump according to claim 10 wherein said injection electrode comprises an electrically conductive core containing a passageway for liquid to be pumped, and terminating in said tip, said conductive core being surrounded by a non-conductive coating.

12. An electrostatic pump according to claim 10, wherein the apex angle of the conical tip of said injection electrode is 36 degrees, and wherein the constriction is also conical, so as to conform to the surface configuration of the tip, the apex angle of the conical constriction being 40 degrees.

13. An electrostatic pump according to claim 7 wherein the tip of said injection electrode is in the form of a blade having a sharpened edge.

14. An electrostatic pump according to claim 7 wherein said injection electrode is screw-threaded into engagement with said housing so that the position of said tip with respect to said orifice may be adjusted.

15. An electrostatic pump according to claim 14 wherein said injection electrode includes a screw-threaded external surface, and further comprising means defining a pair of grooves in said threaded surface of said injection electrode to provide said inlet to said passageway.

16. An electrostatic pump according to claim 7 wherein said collector electrode comprises a smooth metal bush.

17. An electrostatic pump according to claim 7 wherein said housing has internal cross-sectional dimensions substantially greater than the cross-sectional dimensions of said passageway, and wherein a plurality of said injection electrodes with associated passageways are provided within said housing, disposed in parallel with each other, both physically and electrically.

18. An electrostatic pump as recited in claim 17 wherein a single collector electrode cooperates with all of said injection electrodes.

19. An electrostatic pump according to claim 7 wherein said injection electrode includes a body portion in operative engagement with said housing, and means defining grooves in said body portion, said grooves extending generally parallel to said passageway, and defining said inlet to said passageway.

20. A pump assembly comprising a series of pumps each having a housing containing a passageway a single injection electrode, a constriction, a chamber and a discharge electrode as claimed in claim 7, said series of pumps being connected for fluid to flow in series from one to the next through the passageways of each pump, the assembly thereby having at its upstream end an end injection electrode and at its downstream end an end discharge electrode, an injection electrode intermediate said end injection electrode and said discharge electrode acting also as the discharge electrode for the next injection electrode in the upstream direction in the series.

21. An electrostatic pump for pumping liquids, comprising a housing; said housing containing:

a passageway for liquid to be pumped through said housing between an inlet and an outlet;

an injection electrode disposed in an upstream position of said passageway, said electrode having a sharp electricallyconducting tip of conical configuration, and said injection electrode comprising an electrically conductive core containing a passageway for liquid to be pumped, and terminating in said tip, said conductive core being surrounded by an non-conductive coating;

a collector electrode disposed in a downstream position of said passageways and separated from said injection electrode by a chamber downstream from said injection electrode;

means defining an orifice of significantly less cross-sectional area than the cross-sectional area of said chamber, and positioned between said tip and said collector electrode;

electrical connection means for providing electrical connection from a high voltage generator to said injection and collector electrodes to maintain an electric potential on the order of kilovolts therebetween; and said passageway in the region of the tip of said injection electrode being shaped to conform to the surface configuration of said tip so that liquid being pumped flows past the said tip in laminar non-turbulent flow through said orifice into said chamber.

* * * * *